US006029295A

United States Patent [19]

Larmour et al.

[11] Patent Number: 6,029,295

[45] Date of Patent: Feb. 29, 2000

[54] ANNULAR PILLOW WITH METAL MESH MATERIAL COVER

[76] Inventors: James P. Larmour; Mary L. Larmour, both of 9137 Everett Ct., Springfield, Va. 22152

[21] Appl. No.: 09/258,354

[22] Filed: Feb. 26, 1999

[51] Int. Cl.[7] ..... A47C 20/02

[52] U.S. Cl. ..... 5/636; 5/490

[58] Field of Search ..... 5/636, 655, 637, 5/640, 644, 645, 948, 949, 490; D6/601

[56] References Cited

U.S. PATENT DOCUMENTS

| | | | |
|---|---|---|---|
| D. 298,198 | 10/1988 | O'Sullivan | D6/601 |
| 3,400,413 | 9/1968 | Grossa | 5/636 |
| 3,902,456 | 9/1975 | David | D6/601 |
| 4,624,021 | 11/1986 | Hofstetter | 5/949 |
| 4,768,246 | 9/1988 | Summer | 5/636 |
| 5,088,141 | 2/1992 | Meyer et al. | 5/637 |
| 5,279,237 | 1/1994 | Alivizatos | 5/655 |
| 5,708,998 | 1/1998 | Torbik | 5/636 |

FOREIGN PATENT DOCUMENTS

| | | | |
|---|---|---|---|
| 2452899A1 | 5/1976 | Germany | 5/636 |
| 1543887 | 4/1979 | United Kingdom | 5/948 |

*Primary Examiner*—Alexander Grosz
*Attorney, Agent, or Firm*—Michael J. Foycik, Jr.

[57] ABSTRACT

A pillow serving as a cervical support has a metal mesh material cover encasing a resilient padding material. The pillow has an annular shape, thus forming a ring-shaped body. The size of the body should be different, and may be varied, depending upon the age and size of the person using it. For example, a child will benefit from a pillow having a smaller size than would a full-sized adult. An object of the present invention is to provide a proper sleeping posture because of the ring shape, which tends to discourage sleeping in a face-down position.

8 Claims, 1 Drawing Sheet

ANNULAR PILLOW WITH METAL MESH MATERIAL COVER

FIELD OF THE INVENTION

The present invention relates to pillows, specifically, a pillow useful as an aid to enhancing and preserving proper cervical posture in children.

BACKGROUND OF THE INVENTION

The invention is designed to encourage proper cervical/neck support for children during sleep. Pillows are known in the furniture arts for use as headrests for sleeping, cushions for feet, and so on. Such pillows have varying shapes, filling materials, covering materials, textures, fabrics, colors, designs, and so forth.

As children develop, it is important that their neck assume the proper curvature which does not likely result when using a traditional soft pillow. Such soft pillows, when used by children, tend to promote a head-forward position. In addition, the American Association of Pediatricians recommends supine and side posture sleeping, which is not the purpose of the typical pillows known in the art.

Cervical support pillows made for adults would be far too large to be used by children. In addition, it would be a problem in the art to form support pillows so that they need not be properly positioned on only one or two axes to provide the desired effect, since many adults and especially children may not use them in the proper orientation.

SUMMARY OF THE INVENTION

From the foregoing, it is seen that it is a problem in the art to provide a device meeting the above requirements. According to the present invention, a device is provided which meets the aforementioned requirements and needs in the prior art.

Specifically, the device according to the present invention provides proper support through the use of a thin center section surrounded by a much thicker ring which provides the support for a child's neck. The center section is preferably centered along the thickness direction of the pillow. The pillow according to the present invention facilitates correct use of the pillow, since incorrect rotational orientations are prohibited.

The pillow according to the invention has a cover encasing a resilient padding material. The pillow has an annular shape, thus forming a ring-shaped body. The size of the body should be different, and may be varied, depending upon the age and size of the person using it. For example, a child will benefit from a pillow having a smaller size than would a full-sized adult.

An object of the present invention is to provide a proper sleeping posture because of the ring shape, which tends to discourage sleeping in a face-down position.

Another object of the present invention is to provide a device which provides the requisite benefits regardless of how it is positioned upon the bed because of its round, not rectangular, shape.

A still further object of the present invention is to provide a pillow wherein the design and materials used obviate the need for a pillowcase, and thereby precludes suffocation in a very young child.

Other objects and advantages of the present invention will be more readily apparent from the following detailed description when read in conjunction with the accompanying drawings.

BRIEF DESCRIPTION OF THE DRAWINGS

FIG. 2 is a side sectional view of the pillow of FIG. 1, taken along line 2—2 of

FIG. 1.

DETAILED DESCRIPTION OF THE INVENTION

Figure 1:
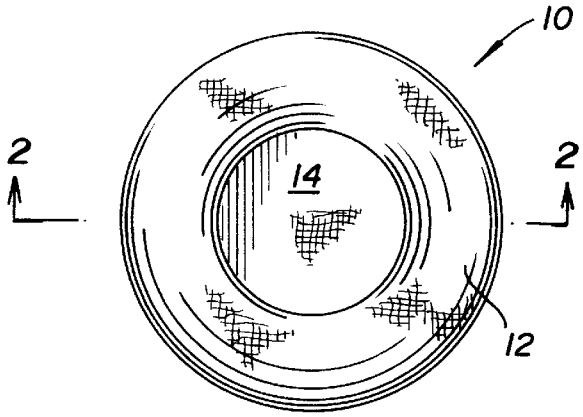
FIG. 1 is a top elevational view of the pillow according to the present invention.

A one piece pillow 10 according to the invention is shown in FIG. 1, having a round annular or ring-shaped body 12. The ring-shaped body 12 has an inner periphery which is connected by a membrane or web 14. The ring-shaped body 12 is formed by a cover which encases a resilient material, as described further hereunder.

Figure 2:
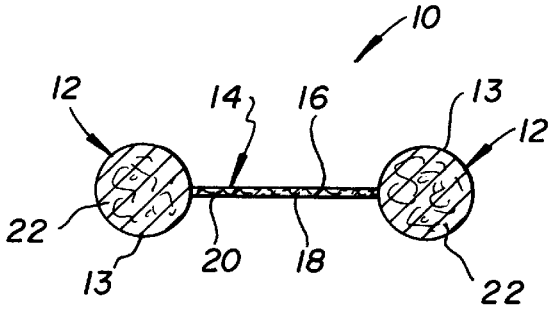

The pillow 10 is shown in side sectional view in FIG. 2, as viewed along line 2—2 of FIG. 1. As seen in FIG. 2, the pillow 10 includes a resilient material 22 in the ring-shaped portion 12. The ring-shaped portion 12 includes a cover 13 which can formed, for example, of a cloth fabric. The web 14 is preferably connected at the innermost periphery of the ring-shaped portion 12. While it is contemplated that the web 14 can be formed as a single piece of fabric, it is preferably formed by a top layer 16 and a bottom layer 18 enclosing a resilient material 20.

While the web 14 is centrally located along the thickness direction of the ring-shaped portion 12, it can, however, also be placed lower or higher along the thickness direction without departing from the scope of the present invention.

The cover 13 is preferably formed by a woven fabric such as a cloth material. It may also be formed from other materials, such as flexible plastic, leather, metal mesh fabric, or other materials known to one skilled in the art. The resilient material 22 is preferably formed of foamed material, and can be formed instead from a cloth stuffing material, rag stuffing material, or fiber fill material, for example. All such non-toxic filling materials, suitable for use by human beings, are contemplated as being within the scope of the present invention.

The web 14 and the cover 13 are preferably machine washable fabrics or materials.

Figure 2A:
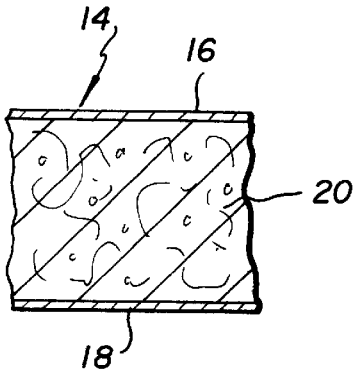
FIG. 2A is an enlarged view of a section of FIG. 2.
Figure 3:
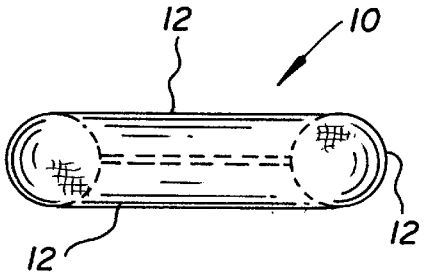
FIG. 3 is a side elevational view of the pillow of FIG. 1.

FIG. 2A is an enlarged view of the central portion of the web 14 of FIG. 2. This figure shows the resilient material 20, the top layer 16, and the bottom layer 18 more clearly than in FIG. 2.

The resilient material 22 of the pillow 10 should be of a material firm enough to support the neck above the level of the back of the head, under the weight of the head upon it.

Figure 4:
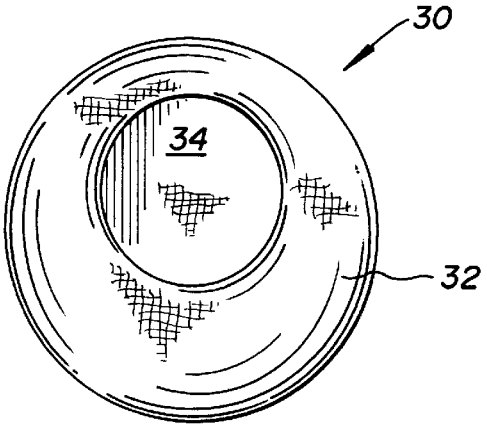
FIG. 4 is an enlarged side sectional view of a central portion of the pillow of FIG. 1.

FIG. 4 shows an alternative embodiment of the invention, wherein a pillow 30 having a non-concentric, annular shape has an irregularly-shaped ring-like body 32. This creates a variable size of channel for the head and area of support for the neck. This would be useful for an older child, perhaps over 3 years of age, who could adjust the pillow to a best position for comfort.

The invention being thus described, it will be evident that the same may be varied in many ways. Such variations are not to be regarded as a departure from the spirit and scope of the invention and all such modifications are intended to be included within the scope of the claims.

What is claimed is:

1. A pillow for use as a cervical support, comprising:

a round, annular, ring-shaped body having a resilient filling material enclosed by a metal mesh material cover, said ring-shaped body having an inner periphery;

a web bridging said inner periphery of said ring-shaped body said web comprising a resilient material enclosed by a top layer and a bottom layer.

2. The pillow as claimed in claim 1, wherein said ring-shaped body comprises non-toxic filling materials, suitable for use near human beings.

3. A pillow as claimed in claim 1, wherein said resilient filling material comprises a fiber fill material.

4. A pillow as claimed in claim 1, wherein said resilient filling material comprises a foamed material.

5. A pillow as claimed in claim 1, wherein said resilient filling material comprises a cloth stuffing material.

6. A pillow as claimed in claim 1, wherein said resilient filling material comprises rag stuffing material.

7. A cervical support as claimed in claim 1, wherein said resilient filling material comprises non-toxic filling materials, suitable for use near human beings.

8. The pillow of claim 1, wherein the annular ring-shaped body has a non-concentric shape.

* * * * *